United States Patent [19]

Copie

[11] 4,268,216

[45] May 19, 1981

[54] LOAD LIFTING AND CARRYING MACHINE

[76] Inventor: Fernand Copié, RayGo, Inc., 9401 85th Ave. N., Minneapolis, Minn. 55445

[21] Appl. No.: 921,762

[22] Filed: Jul. 3, 1978

[30] Foreign Application Priority Data

Jul. 4, 1977 [GB] United Kingdom ..... 27963/77

[51] Int. Cl.[3] ..... B66C 23/72

[52] U.S. Cl. ..... 414/719; 414/673; 414/733; 414/917; 212/196

[58] Field of Search ..... 414/673, 719, 733, 917, 414/546, 555; 212/48, 49, 196

[56] References Cited

U.S. PATENT DOCUMENTS 3,239,080 3/1966 Corompt ..... 414/546 X
3,367,512 2/1968 Kaplan ..... 414/680 X

FOREIGN PATENT DOCUMENTS 596613 8/1959 Italy ..... 212/49
327478 4/1930 United Kingdom ..... 212/49

*Primary Examiner*—Stephen G. Kunin
*Assistant Examiner*—Terrance L. Siemens
*Attorney, Agent, or Firm*—Burd, Bartz & Gutenkauf

[57] ABSTRACT

A wheel-mounted load lifting and transporting machine having load engaging elements at its front end and a counterweight at its rear end, is distinguished by a novel interacting mobility between the counterweight and the load-engaging elements by which the tilting moments imposed upon the machine by the counterweight and by a load suspended from the load engaging elements, at all times offset one another with the result that throughout changes in the location of the picked up load with respect to the wheel locations, a line that passes vertically through the center of gravity of the loaded machine is substantially equispaced from the points at which the wheels of the machine rest upon the ground. For optimum handling of the machine, each of the wheels on which it is mounted is steerable and power driven to the end that the machine can be moved in any direction and along any defined path.

7 Claims, 11 Drawing Figures

10
22
22b
22a
24
12
25
25'
31
34
19
23
21
35
32
15
19'
20
33
18
17
16
26
27
9
8
5
11

Fig. 10
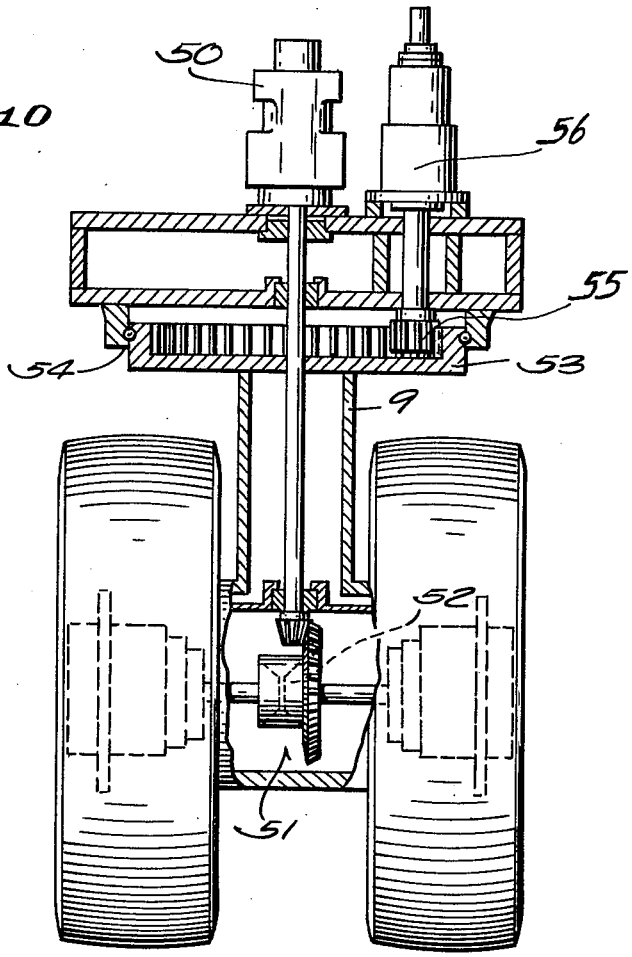
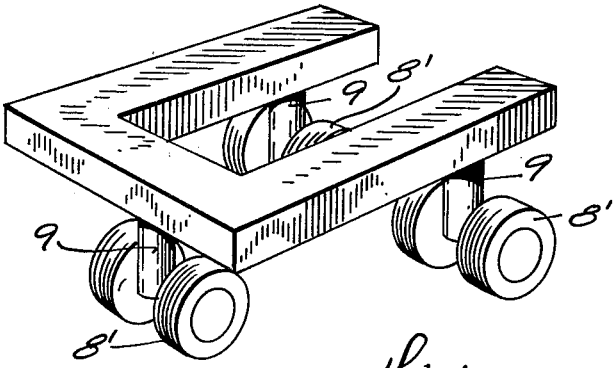
Fig. 11

LOAD LIFTING AND CARRYING MACHINE

This invention, relates to load handling machines and refers more particularly to a machine for lifting and transporting heavy loads. An example of the work performed with such machines is the lifting of large freight containers onto and off of transport trucks. Another use for which such machines are especially well adapted is the movement of large heavy loads—palletized or not—from one location to another in a plant, stock room or warehouse. Handling the relatively large and very heavy rolls of sheet steel produced by steel mills has always posed a problem and in fact the solution of that problem was a motivating factor in the development of the instant invention.

Conventional load lifting and transporting equipment to which the present invention is most nearly related are so-called front end loaders and lift trucks. These machines have wheel mounted chassis with load engaging instrumentalities at the front end and a counterweight at the rear. Since the counterweight is at a fixed location on the chassis of these conventional machines, the load borne by their front and rear wheels is seldom, if ever, the same.

In a front end loader, the load engaging structure is projectable to reach out and pick up the load, and retractable to facilitate transporting the load. With the load engaging structure extended and lifting the load, practically the entire weight of the machine and its load is borne by the front wheels; and, if the weight of the load is the maximum for which the machine is designed, its rear wheels are apt to be lifted off of the ground or floor. While the imbalance between the weight borne by the front and rear wheels of a lift truck may not be as great as it is in a front end loader, there still is an objectionable difference that stems from the fact that the counterweight is in a fixed location.

This inevitable lack of uniformity in the distribution of the weight borne by the wheels of front end loaders, lift trucks and other wheel-supported conventional load lifting and transporting machines gives rise to a host of problems and disadvantages. Not least of those is the severe tire fatigue that results from movement of the machine from one location to another while some of its tires are overloaded and the others carry practically no load. That unequal weight distribution results in poor handling and instability of the machine, which makes it unsafe to operate on terrain that has anything but an ideal surface.

With a view to overcoming the aforesaid shortcomings of conventional wheel-mounted load lifting and transporting machines, the present invention has as its purpose and object the provision of a wheel-mounted load lifting and transporting machine which is characterized by a new and novel interacting mobility between the counterweight and the load engaging and lifting instrumentalities of the machine, by which the location of the counterweight with respect to the front and rear wheels of the machine is shifted compatibly with the changes in the location of the picked-up load with respect to the wheel locations, to the end that at all times the total weight of the machine while carrying a load is substantially uniformly distributed over all of its wheels.

In the illustrated embodiment of the invention both the load lifting structure and the counterweight are mounted to swing about a common axis and a parallelogram linkage interconnecting them shifts the counterweight outward with respect to the chassis of the machine as the load lifting structure is extended, and swings the counterweight inward as the load lifting structure is retracted.

Since the boom swings about a fixed horizontal axis at the rear of the machine and the load engaging structure is mounted on the free end of the boom, the point of connection of that structure with the boom moves in an arc as the boom is raised or lowered. But for various reasons, it is undesirable to have the load carried by that structure, constrained to travel along an arcuate path; for one, such arcuate travel of the load would increase the tilting moment imposed upon the machine by the load at a time when the tilting moment resulting from the counterweight remains unchanged. Accordingly, the invention has as a significant feature thereof the provision of means incorporated in the load engaging and lifting instrumentalities by which the operator can control the path along which the load moves as it is raised or lowered despite the arcuate path of the free end of the boom to which the load engaging structure is connected.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate an example of the invention constructed according to the best modes so far devised for the practical application of the principles thereof, and in which.

Figure 1:
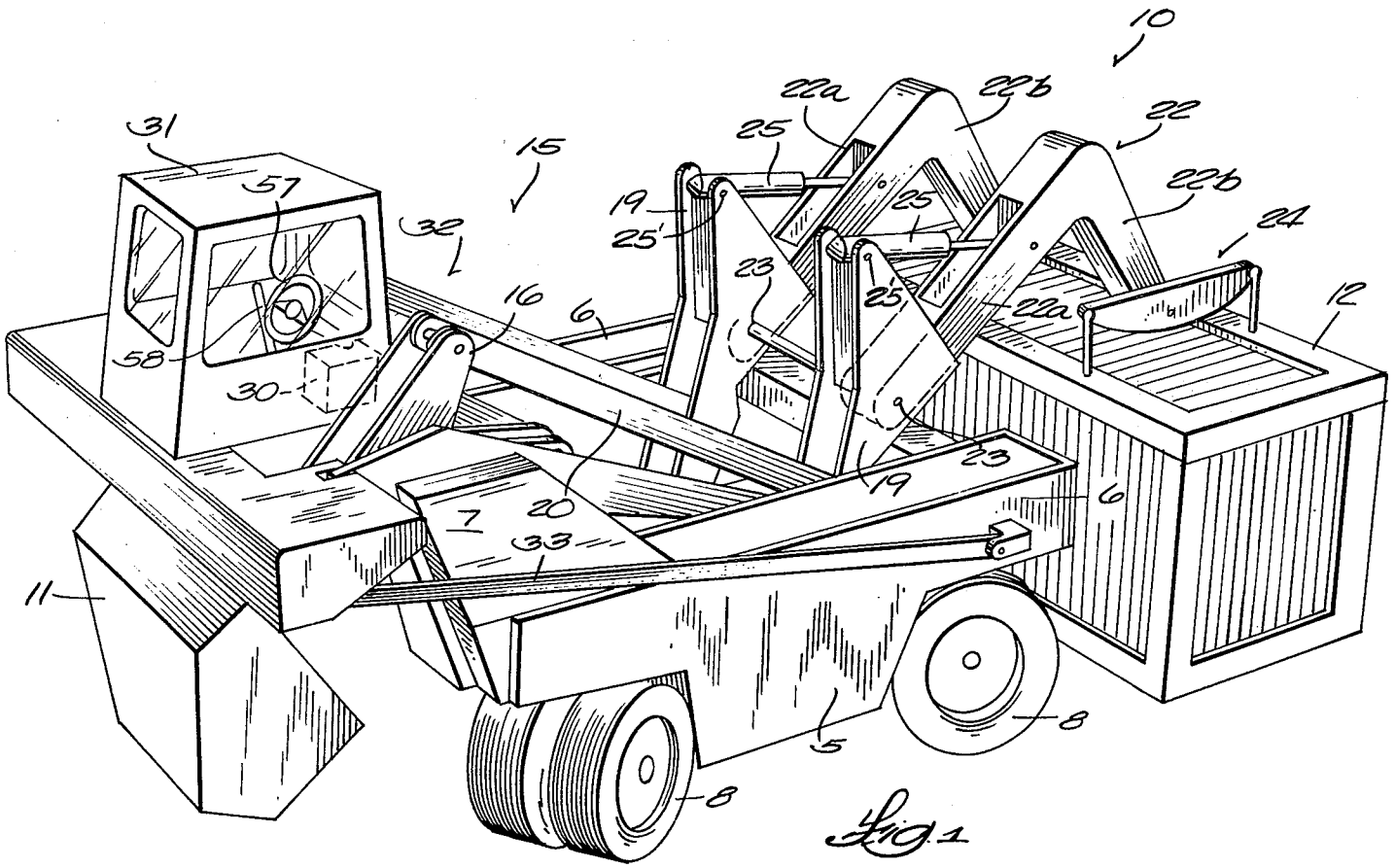
FIG. 1 is a perspective view of the load lifting and transporting machine of this invention, shown with its load lifting structure extended and picking up a standard freight container and the counterweight in its rearwardmost location, to thus most effectively counterbalance the load.
Figure 8:
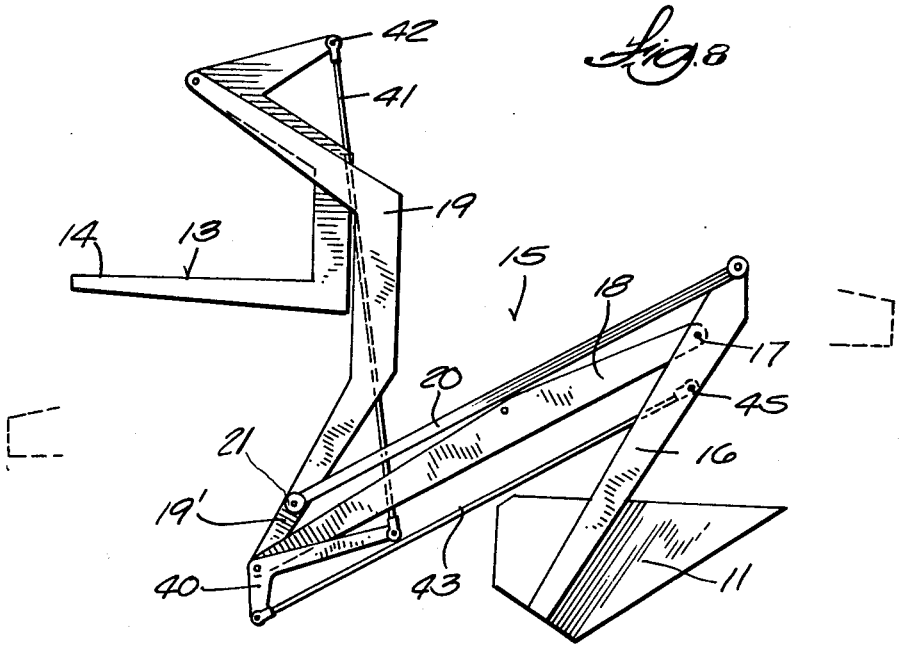
Figure 9:
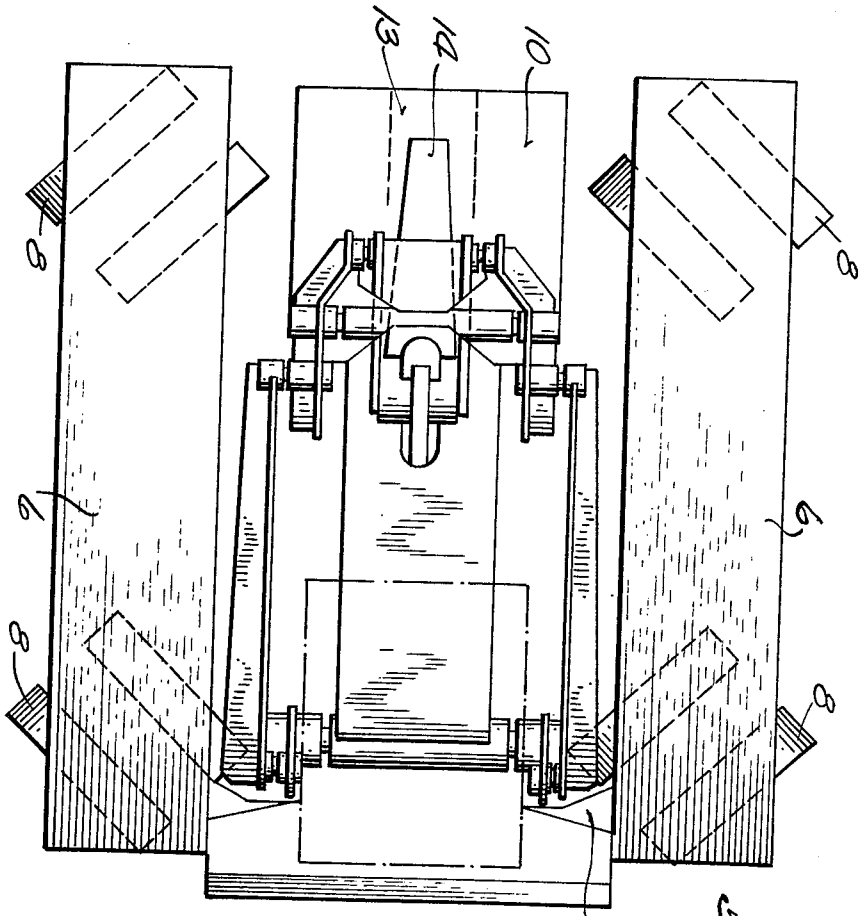

FIGS. 5, 6, 7 and 8 diagrammatically illustrate the parallelogram linkage by which the load lifting structure and the counterweight are connected, and show how that linkage correlates the location of the counterweight with changes in the location of the load engaging part of the structure, which, in these views is designed to handle such loads as large coils of sheet steel. The different positions of the load lifting structure and the counterweight shown in these views substantially correspond with the locations thereof respectively illustrated in FIGS. 1–4;

FIG. 9 is essentially a top plan view of the machine with its load lifting structure and the counterweight in the positions shown in FIG. 8;

FIG. 10 diagrammatically illustrates the wheel propelling and steering mechanism that is employed in the machine of this invention;

FIG. 11 diagrammatically illustrates the use of three pairs of wheels to mount the machine in lieu of one such pair at each of the four corners of the chassis shown in FIGS. 1 and 9.

Referring to the accompanying drawings, in which like numerals identify like parts, the numeral 5 denotes the chassis or base of the machine. As is customary in heavy material handling machines, the chassis 5 is a rigid fabricated steel structure and, for the purposes of this invention, it is U-shaped with fore and aft extending parallel side members 6 connected by a cross member 7. This cross member constitutes the rear end portion of the chassis.

Figure 2:
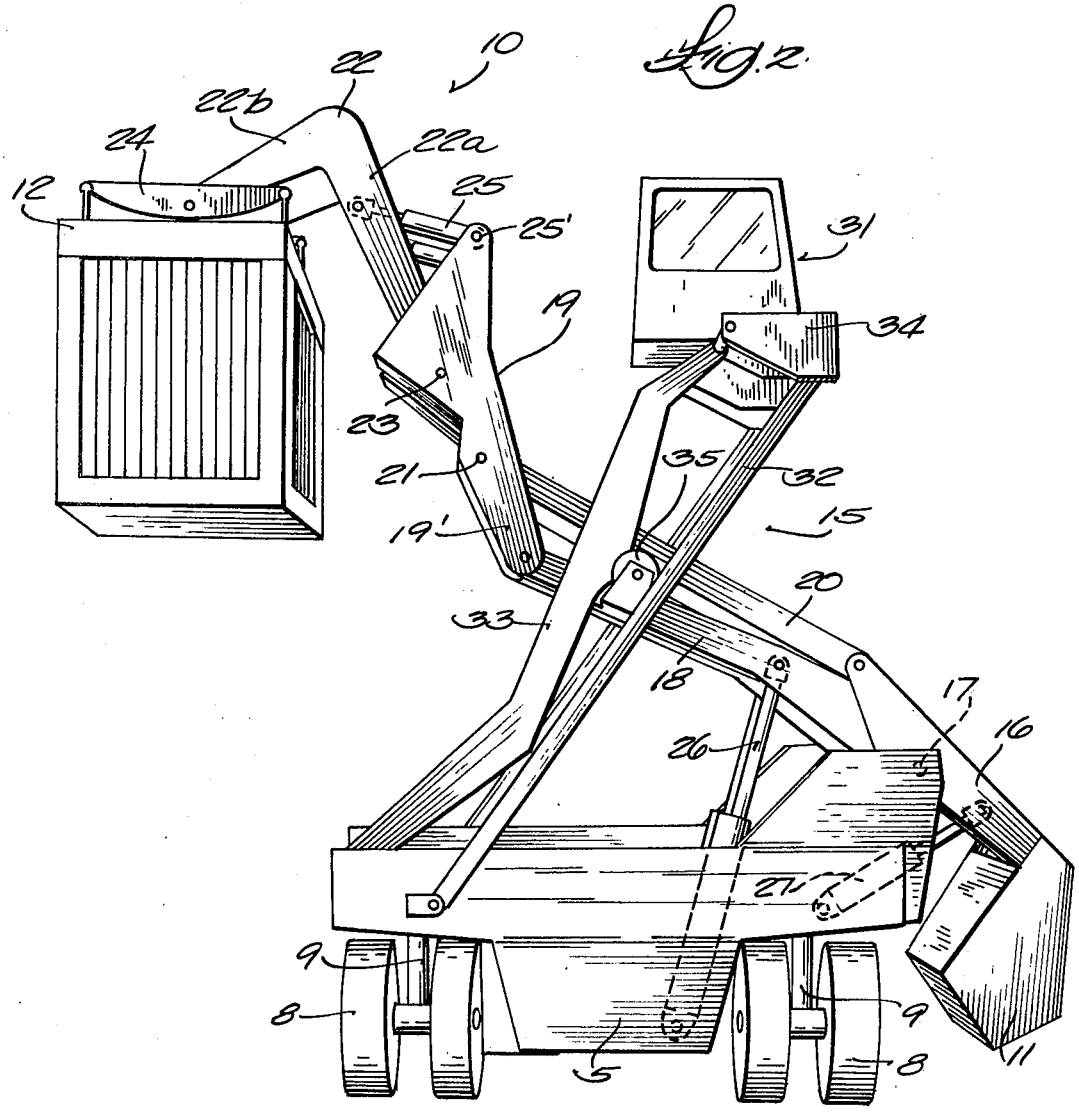
FIG. 2 is essentially a side view of the machine illustrating the load lifting structure in an elevated posture, and the counterweight still located outwardly beyond the rear of the chassis.
Figure 3:
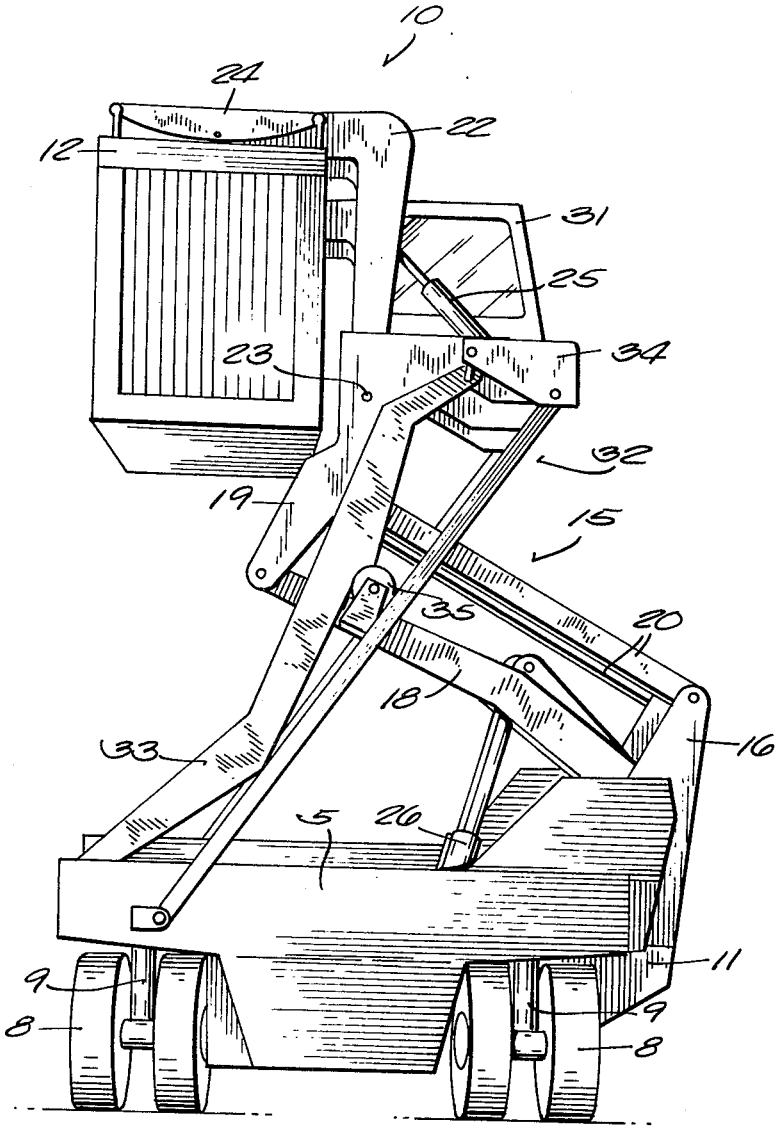
FIG. 3 is a view similar to FIG. 2 but showing the load lifting structure elevated to its maximum height and the counterweight so located that its center of gravity, like that of the load, lies within the front and rear boundaries of the chassis or base of the machine.
Figure 4:
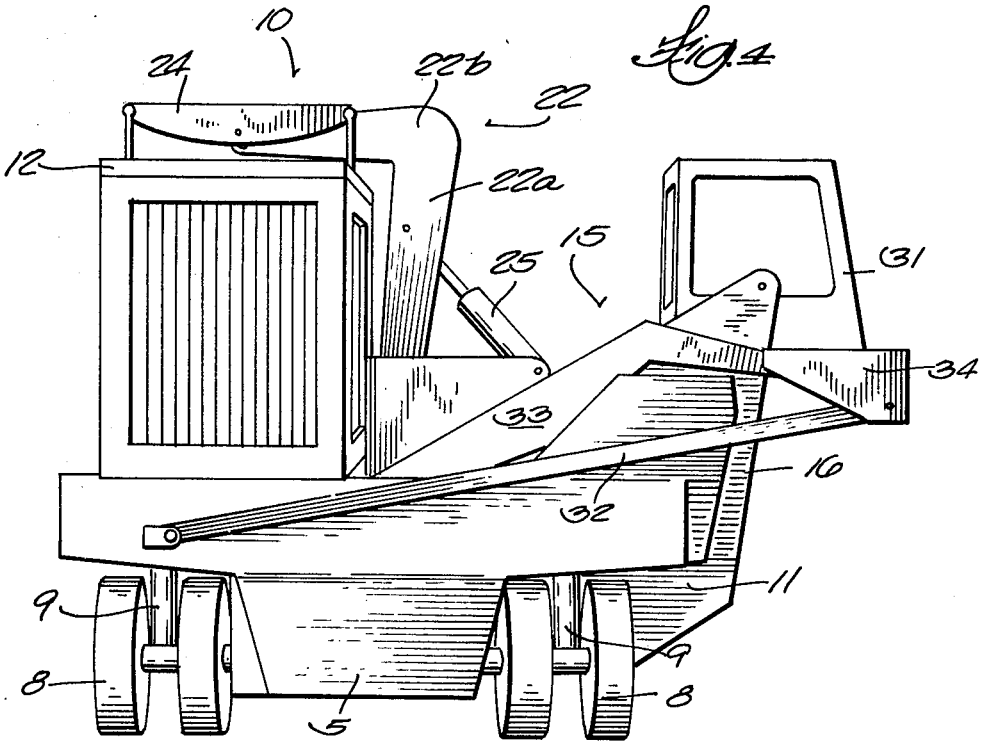
FIG. 4 is again essentially a side view of the machine like FIGS. 2 and 3, showing the load lifting structure in the position it occupies during transit of the machine, with the load resting on chassis and the counterweight in its retracted position.
Figure 5:
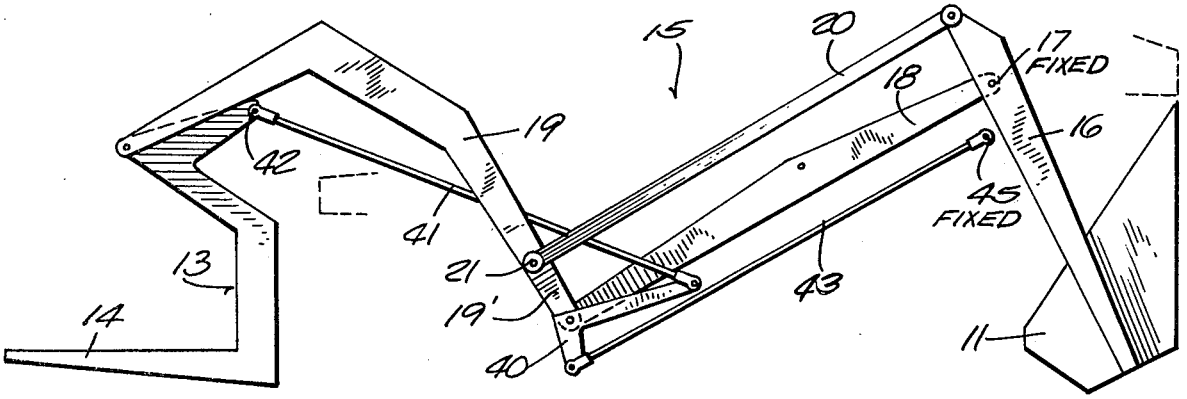
Figure 6:
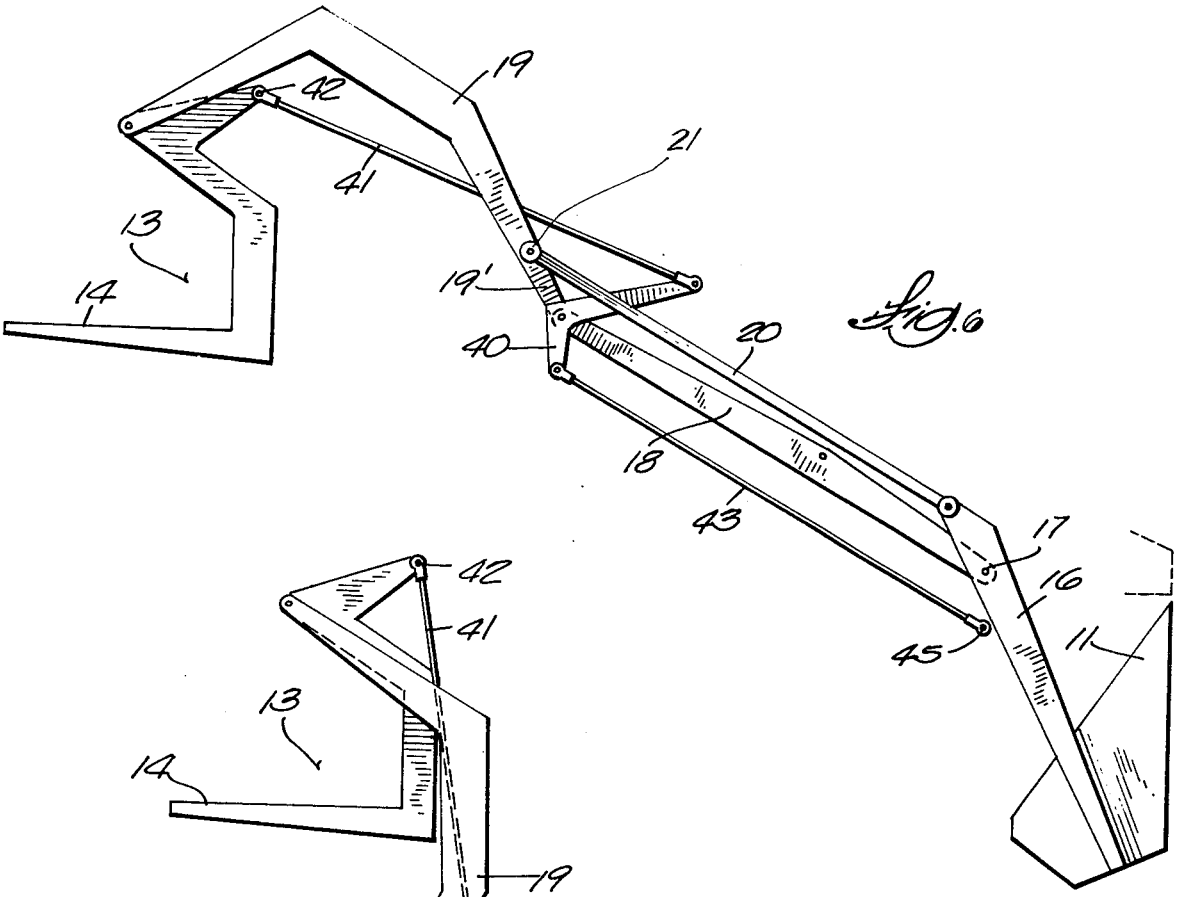
Figure 7:
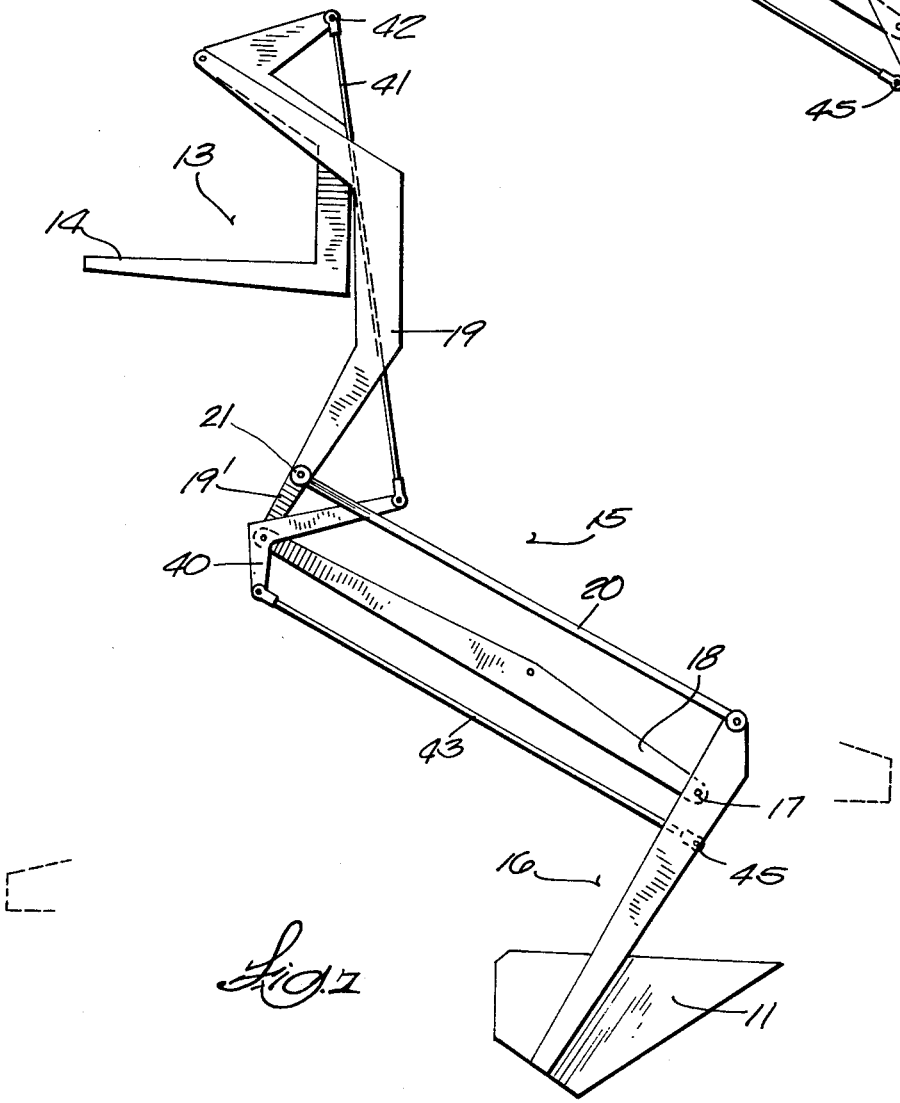

The chassis is portably supported by four pairs of rubber-tired wheels 8 located at the corners of the chassis. Each pair of wheels is steerably and drivingly mounted at the bottom of a hollow leg-like post 9 that projects down from the chassis. This steerability of the wheels enables the machine to travel in any selected direction. To illustrate, with the wheels oriented as they are in FIG. 1, the direction of travel would be substantially forward or rearward, while with the wheels as shown in FIGS. 2, 3 and 4, it would be sidewise, in the selected direction.

At the front of the chassis is the load lifting structure 10 of the machine and at its rear is its counterweight 11.

In FIGS. 1–4 the illustrated load lifting structure is arranged to handle standard freight containers for which purpose a suspended spreader frame 12 is provided for releasable attachment in the customary way to the upper four corners of the freight container. In FIGS. 5–8 the load lifting structure has a load engaging device in the form of an angle-shaped member 13 with a forwardly projecting probe or finger 14 to enter the hollow center of a roll—as, for instance, a heavy roll of sheet steel.

Regardless of the specific nature of the load to be lifted and the type of load engaging device employed therefor, the load lifting structure or instrumentalities and the counterweight are interconnected by a parallelogram linkage identified generally by the numeral 15. Although that linkage assembly is illustrated in FIGS. 1–4, the following description thereof will be best understood by reference to FIGS. 5–8. It should also be understood that for maximum stability in the lifting of a load, especially where the load is in the nature of a standard freight container which must be picked up at relatively widely spaced points, the parallelogram linkage is duplicated at opposite sides of the median fore and aft vertical plane of the machine. FIG. 1 illustrates that duplication, but for simplicity, the description thereof will be in the singular.

The parallelogram linkage includes a medially pivoted lever 16 that rocks about a horizontal axis 17 fixed with respect to the rear edge of the base or chassis. One arm of that medially pivoted lever, the longer downwardly projecting one, has the counterweight 11 attached thereto; the other shorter upwardly projecting arm forms one of the two shorter ones of the four elements of the parallelogram linkage.

A boom 18 that swings about a horizontal axis that is fixed with respect to the base, and as shown, may be the same fixed horizontal axis 17 about which the medially pivoted lever 16 rocks, is one of the two long elements of the parallelogram. The outer extremity or free end of the boom 18 has a rigid arm 19 pivoted thereto; and a connecting rod 20 having one of its ends pivoted to the outer extremity of the short arm of the medially pivoted counterweight-carrying lever 16 and its other end pivoted to the arm 19, as at 21, constitutes the second long element of the parallelogram. The fourth element of the parallelogram is formed by that part 19' of the arm 19 that extends between the point 21 and the free end of the boom 18. Preferably, though not necessarily, the boom and the connecting rod 20 are of the same length, as are also the short arm of the medially pivoted lever 16 and the part 19' of the arm 19. With its elements thus dimensioned, the linkage forms a true parallelogram.

The arm 19 can have specifically different load engaging devices mounted thereon. Thus, for handling standard freight containers, as shown in FIGS. 1–4, an L-shaped load supporting unit 22 is pivoted to the outer end of the arm 19, as at 23. At one defined limit of its swinging movement around the pivot 23 the inner leg **22*a* of the L-shaped unit 22 forms an extension of the arm 19 and its outer leg 22*b* projects forwardly, and has load attaching means 24, including the spreader 12, suspended from its outer end. In effect, the arm 19 and the unit 22** pivoted thereto constitute two sections of an articulated load supporting structure.

Power means 25 which may be of any conventional type, as for instance a hydraulic or a pneumatic cylinder, reacts between a point 25' on the arm 19 and the L-shaped unit 22 to swing these articulated sections of the load supporting structure between a fully extended condition in which the load attaching means 24 reaches well beyond the front edge of the chassis when the parallelogram linkage is extended, as it is in FIG. 1, and a partially folded condition in which the load attaching means is rearward of its fully projected location.

Without disturbing the parallelogram linkage, a load suspended from the attaching means 24 can be lifted by actuation of the power means 25, to swing the L-shaped supporting unit about its pivotal attachment 23 with the arm 19; but the primary lifting of the load is done by raising the boom 18 by a lifting cylinder or motor 26.

An especially advantageous feature of the aforesaid load lifting structure is that a load suspended therefrom can be raised or lowered along a path that is not constrained to that of the outer free end of the boom, which path of course is arcuate. This advantage stems from the articulated nature of the load lifting structure. By virtue of that characteristic the path of the suspended load can be guided to move vertically while the free end of the boom 18 swings in an arc.

When the geometry of the parallelogram linkage 15 is adjusted to bring the picked-up load to the location best suited for transport, and to tuck the counterweight 11 under the chassis, as shown in FIGS. 4 and 8, a vertical line that passes through the center of gravity of the machine intersects the zone defined by the points of contact between the wheels and the ground, at a location substantially equispaced from those points. Not only does this advantageous condition result in greatly improved stability and manoeuverability of the machine, but it also enables the machine to operate in aisles that are narrower than the width required by conventional wheel-mounted load handling equipment.

As explained, adjustment of the angular relationship between the pivotally connected arm 19 and the L-shaped unit 22, and raising and lowering of the boom 18 is produced by controlled operation of the motors 25 and 26. To effect concomitant projection of the load lifting structure and of the counterweight and concomitant retraction thereof, the geometry of the parallelogram is appropriately altered. That is done by controlled operation of a motor 27 that reacts between the medially pivoted lever 16 and the chassis.

While these motors have been depicted as of the pressure fluid type, they can be of any variety, including electrically driven lead screws, but whatever their nature may be, by properly controlling their operation the operator governs the functioning of the machine.

During concomitant extension or retraction of the load lifting structure and the counterweight by operation of the motor 27, the boom 18 remains stationary but the other three elements of the parallelogram move to alter its geometry in the manner depending upon whether the load lifting structure is being extended or retracted. If the load is only raised or lowered, the element of the parallelogram supplied by the counterweight-supporting lever 16 is stationary and the other parts of the linkage move. In each instance, therefore, three members of the parallelogram are moving while the fourth remains stationary. However, when a composite of extension or retraction and lifting or lowering of the load is involved, all four elements of the parallelogram move.

These power-produced motions are controlled by manual actuation of a control linkage which is an image of the load and counterweight carrying structure and has a handle that represents the load. That control linkage—diagrammatically indicated at 30 (FIG. 1)—is located in an operator's cab 31. Manipulation of this control linkage, acting through conventional servo means, effects activating response of the different motors, as required to move the load along a desired path.

An exceptionally significant feature of the invention resides in the manner in which the operator's cab is mounted on the machine. As distinguished from the conventional practice of placing the cab at a fixed location on the chassis, it is carried by a scissors-like linkage 32 that raises and lowers the cab location conformably with changes in elevation of the load engaging structure. To a degree, the cab-supporting structure utilizes the geometry of a parallelogram to keep the cab orientation uniform, regardless of the elevation of its location. To that end, the scissors-like linkage 32, which is duplicated at opposite sides of the machine, has coacting long arms 33 that are pivoted at one end to the chassis near its front, and at the other end are pivoted to a platform 34 on which the cab is mounted. One of the arms 33 sets on a roller 35 freely rotatably mounted on the boom 18, so that as the boom moves to raise or lower the load, the cab location at all times affords the operator an excellent view of the load-engaging device.

As already noted, the geometry of the load-engaging structure depends upon the nature of the load to be handled. Thus, when the load is in the form of a heavy roll of sheet steel, the load-engaging device, as hereinabove explained, is preferably in the form of the angle-shaped member 13 with a forwardly projecting horizontal probe or finger 14. As shown in FIGS. 5–8, this angle-shaped member is pivotally suspended from the outer end of the arm 19. It is maintained in its operative load supporting orientation with its forwardly projecting probe or finger horizontal, by a connection between it and the parallelogram linkage of the load lifting structure. That connection comprises a long and short armed bell crank 40 pivotally mounted on the outer end of the boom 18, a connecting rod 41 extending between the long arm of the bell crank and a point 42 on the angle-shaped member 13 spaced from its pivotal connection with the outer end of the load lifting arm 19, and another connecting rod 43 extending between the short arm of the bell crank 40 and a fixed point 45 on the chassis near the pivot axis 17 of the boom.

Attention is directed to the fact that the arm of the medially pivoted lever 16 to which the counterweight is secured projects downwardly from its hinged support and swings between rearwardly and forwardly inclined positions to move the counterweight between its rearwardmost and forwardmost positions. By virtue of the shape of the counterweight and its disposition with respect to the arm to which it is secured, even in its rearwardmost position it does not project objectionably beyond the rear of the chassis, though its center of gravity is most effectively located from the standpoint of counterbalancing the projected load-lifting structure. Another observation about the way in which the counterweight is supported is that it contributes to the attainment of a low center of gravity for the machine.

Each of the four pairs of rubber-tired wheels by which the machine is supported is capable of being power driven to effect propulsion of the machine in any one of four different steering modes: (1) front mode, (2) side mode, (3) crab mode, and (4) turntable mode. As illustrated in FIG. 10, the driving means for each pair of wheels consists of a vertical shaft motor 50—hydraulic or electric—mounted above and in line with its respective hollow leg-like post 9, and a drive transmission 51 including a conventional differential gear 52 connecting the motor with the axle of the wheels.

For steering purposes, each of the hollow leg-like posts is fixed to and projects down from an internal ring gear 53 that is rotatably mounted at the underside of the chassis by a bearing 54. A pinion 55 meshing with this ring gear and driven by a motor 56 provides power means for rotating the post 9.

By means of a novel steering system which includes a steering wheel 57 or its equivalent, located in the operator's cab, the operator initiates and controls operation of the four steering motors 56. Rotatable indicators, also located in the cab, and operatively connected with the wheels to identify their orientation with respect to the chassis, are incorporated in the steering system to facilitate the operator's control of the machine.

The steering system also includes another manually manipulatable control member 58 by which the orientation of the wheels with respect to the chassis is adjustable to enable the machine to be moved in any of the aforesaid modes. With the orientation of the wheels set for travel of the machine in the first mode, steering can be effected by either the leading wheels only, the trailing wheels only, or by both leading and trailing wheels. For the second steering mode—i.e. steering sidewise propulsion of the machine, the control member 58 is actuated to properly orient the wheels and to effect a ninety degree (90°) shift in the command transmitting connections between the steering wheel and the steering motors 56. Hence, steering by either the leading or trailing wheels only, or both, is again possible but of course, with the machine moving sidewise in the selected direction.

For steering in the third or crab mode—which can be either forward-backward or sideward in either direction—the steering commands sent to both the leading and trailing wheels effect steering motion of all of the wheels in the same direction. And, finally, for the fourth or turntable mode, the control system is adjusted by the control member 58 to cause the axles of the diagonally opposite pairs of wheels to be brought into coaxial alignment, as they are in FIG. 9. With the wheel axles thus oriented, manipulation of the steering wheel results in rotation of the machine, in the selected direction, about a vertical axis that passes through the intersection of the axes of the coaxial diagonally opposite pairs of wheels. Since the internal ring gears 53 and the leg-like posts 9 depending therefrom are all rotatable through 360°, it follows that a reversing gear is not required to change the direction in which the machine turns when in the turntable mode.

While the steering system referred to above, as such, forms no part of this invention, it is significantly important that by this invention the machine is adapted to be controlled by that system and that, as a result thereof, sidewise movement of the machine is steerable in identically the same way as frontward or rearward travel. Heretofore there has never been a four-wheeled vehicle that had the capability of being steered in exactly the same way whether the machine was moving sidewise or forward. Sidewise movement of the machine, achieved by utilization of the crab mode of steering, cannot alter the orientation of the fore and aft axis of the machine in space or with relation to the location of a load to be picked up. Nor is it possible in the crab mode of steering to turn the wheels at the inside and outside of a curve in a path to be followed, through different angles as scientifically correct steering requires. To achieve that result entails exactly the same steerability that is possible in the front mode. As noted, that has not heretofore been possible, but with this invention—and by virtue of the fact that it provides for ninety degrees (90°) reorientation (in either direction) between the command signals emanating from the steering wheel 57 and the steering motors 56 of all four pairs of wheels, it is possible to steer sidewise movement of the machine in identically the same way as forward travel.

As will no doubt be evident, by having all wheels driven and steerable, maximum steering control and traction are assured and, of course, by virtue of the differential gearing in the drive to the wheels, rotation of the outermost and innermost wheels—with reference to the turning radius center—will be proportionately different as the situation requires.

As an alternative to the four-wheeled support for the machine, the three-wheeled arrangement illustrated in FIG. 11 may be used. The same leg-like ports 9 are employed to mount the three pairs of wheels 8' at the underside of the chassis. One of the three pairs of wheels is centered under the bight portion of the U-shaped chassis and the other two are under the side arms of the chassis, at the front of the machine where the load lifting structure is located. This "tripod" support is actually preferred over the use of wheels at each of the four corners of the chassis because it is better adapted to traverse uneven ground, but without the interacting mobility between the counterweight of the load lifting structure that this invention provides, a tripod support would not be practical.

As with the four-wheeled arrangement each of the three pairs of wheels 8' can be power driven in either direction and, except for the difference that results from there being only three, rather than four pairs of wheels, steering is accomplished as with the four-wheeled design.

Those skilled in the art will appreciate that the invention can be embodied in forms other than as herein disclosed for purposes of illustration.

The invention is defined by the following claims:

I claim:

1. A load lifting and transporting machine comprising:

A. a movably mounted base;

B. load engaging means;

C. load counterbalancing means;

D. structure by which the load engaging means is mounted on the base for elevation and descent and for projection and retraction thereof with respect to the base, said structure comprising (1) a boom having inner and outer ends, (2) pivot means connecting the inner end of the boom with the base, the axis of said pivot means being fixed with respect to the base and being horizontal so that the boom is constrained to up and down swinging motion with its outer free end traveling in an arcuate path, (3) a rigid arm having the load engaging means attached thereto, and (4) means connecting said rigid arm with the outer free end of the boom in a manner accommodating relative movement therebetween with the load engaging means traveling towards or from said horizontal axis about which the boom swings;

E. means by which the load counterbalancing means is mounted on the base for projection and retraction thereof relative to the base;

F. a connecting rod capable of transmitting force in either direction along a path parallel with its longitudinal dimension;

G. means joining one end of the connecting rod with said means by which the load counterbalancing means is mounted on the base and its other end with said rigid arm, so that the boom, the connecting rod, and portions of said rigid arm and of said means by which the load counterbalancing means is mounted on the base, form elements of a linkage assembly of alternate geometry that connects the load engaging means with the load counterbalancing means, and by such connection constrains the same to concomitant projection or retraction with respect to the base, and by alteration of its geometry effects such concomitant projection or retraction, regardless of the position of elevation of the boom, whereby tilting movements respectively produced by a load on the load engaging means and by the load counterbalancing means at all times oppose one another; and H. controllable power means operable (1) to raise the boom and control its descent, and (2) to alter the geometry of the linkage assembly, so that by controlled operation of said power means the machine can be caused to lift or lower a load, place a load on its base or lift a load off its base without significantly shifting the location of the center of gravity of the machine.

2. The load lifting and transporting machine of claim 1, wherein

A. the means by which the load counterbalancing means is mounted on the base comprises a lever pivoted to the base to swing about a horizontal axis that is fixed with respect to the base, is parallel with the axis about which the boom swings and is located medially of the ends of the lever and thus divides the lever into oppositely swinging upwardly and downwardly projecting end portions, the latter having the load counterbalancing means fixed thereon and the former having the adjacent end of the connecting rod joined thereto; and B. wherein the connection between said rigid arm and the outer free end of the boom is provided by a pivot, so that the relative movement between the arm and the boom accommodated by said connection is pivotal and takes place about the axis of said pivot; and C. wherein the connection of the connecting rod with said rigid arm is spaced from the axis of said pivot, so that the upwardly projecting end portion of the medially pivoted lever and the portion of said rigid arm between its connection with the connecting rod and its pivotal connection with the boom constitute two opposite elements of said linkage assembly and co-act with the boom and the connecting rod to give said linkage assembly a parallelogram identity.

3. The load lifting and transporting machine of claim 2, wherein the axis of the pivotal connection between the base and said lever coincides with the axis of the pivot means by which the inner end of the boom is connected with the base.

4. The load lifting and transporting machine of claim 2 further characterized in that the axis about which said medially pivoted lever swings is so located with respect to the base that the load counterbalancing means fixed to the downwardly projecting end portion of said lever, moves to a location under the adjacent portion of the base when the load engaging and lifting means is moved to a position in which a load carried thereby can be set on the base.

5. The load lifting and transporting machine of claim 1, further characterized in that said load engaging means comprises:

A. Pivotally connected inner and outer sections, the latter having means thereon to which a load may be attached, and the former being a part of said rigid arm, the pivotal connection between said sections enabling a load attached to the outer section to be moved along an operator selected path not constrained by the arcuate path of the free end of the boom; and B. manually controllable power means reacting between said pivotally connected inner and outer sections to selectively adjust their geometrical relationship and hence the path of a load attached to the outer section as the load is raised or lowered.

6. The load lifting and transporting machine of claim 1, further characterized in that A. said load engaging means is a bell crank having divergent legs and pivoted at the junction of its legs to said rigid arm; and B. means connecting the bell crank with the boom and with a point fixed with respect to the base, to maintain the bell crank in such relationship to the boom that one leg of the bell crank is and remains substantially horizontal regardless of changes in the angular disposition of the boom relative to the base.

7. The load lifting and transporting machine of claim 1, further characterized by A. an operator's cab containing instrumentalities by which the operation of the machine is manually controllable;

B. means movably mounting said operator's cab above the base; and

C. means connecting said cab mounting means with said linkage assembly and operable to maintain the operator's cab at a location from which an operator therein has a good view of the load engaging and lifting means throughout the entire range of its movement.

* * * * *

UNITED STATES PATENT AND TRADEMARK OFFICE

CERTIFICATE OF CORRECTION

PATENT NO. : 4,268,216

DATED : May 19, 1981

INVENTOR(S) : Fernand Copie

It is certified that error appears in the above-identified patent and that said Letters Patent are hereby corrected as shown below:

Column 3, line 47, after "linkage" insert -- assembly --.

Column 7, line 52, "ports" should be -- posts --.

Column 8, line 45, "alternate" should be -- alterable --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*